United States Patent [19]

Shimizu

[11] Patent Number: 4,478,445

[45] Date of Patent: Oct. 23, 1984

[54] DOOR HANDLE ASSEMBLY

[75] Inventor: Keiichi Shimizu, Tokyo, Japan

[73] Assignee: Kokusan Kinzoku Kogyo Kabushiki Kaisha, Tokyo, Japan

[21] Appl. No.: 336,930

[22] Filed: Jan. 4, 1982

[51] Int. Cl.[3] ..... E05C 13/04

[52] U.S. Cl. ..... 292/336.3; 403/70

[58] Field of Search ..... 292/DIG. 38, DIG. 25, 292/166, 336.3; 403/69, 70, 71, 163

[56] References Cited

U.S. PATENT DOCUMENTS

| | | | |
|---|---|---|---|
| 793,758 | 7/1905 | Woodman | 403/163 |
| 3,233,930 | 2/1966 | Becker | 403/163 |
| 3,967,844 | 7/1976 | Torii et al. | 292/336.3 |

FOREIGN PATENT DOCUMENTS

| | | | |
|---|---|---|---|
| 2131398 | 2/1979 | Fed. Rep. of Germany | 292/336.3 |

*Primary Examiner*—Richard E. Moore

*Attorney, Agent, or Firm*—Fleit, Jacobson, Cohn & Price

[57] ABSTRACT

The invention provides an improved outside door handle assembly comprising a door handle and a door latch releasable operating rod connected pivotably with each other without execution of any mechanical after fabrication of the related parts. For this purpose, a pair of finger projections are provided and made integral by a resin material with the door handle. One of these finger projections bears a return coil spring for the door handle, while the other carries no such spring means. The spring bearing-finger projection comprises two finger elements which are formed with two half bearing recesses for providing jointly a pair of axially staggered bearing halves adapted for pivotably receiving the middle part of a Z-shaped end of the operating rod.

2 Claims, 5 Drawing Figures

DOOR HANDLE ASSEMBLY

BACKGROUND OF THE INVENTION

The present invention relates to improvements in and relating to an outside door handle assembly, especially adapted for use on automotive vehicles. The handle proper or arm of such outside door handle assembly is connected mechanically through a rather long rod with the door latch operating mechanism in such a way that when the door handle is raised manually upwards against spring action, the door latch is released, as is well knwon among those skilled in the art. When the operator releases his hand from the door handle, the handle is returned from the upper raised service position to the lower regular off-service position automatically by spring action.

In the conventional art, the mechanical pivotable connection of the door handle with the door latch operating rod must be carried out through rod-end bending, rod-end press-out or the like, for the purpose of unintentional slip-out disengagement of the rod from the door handle assembly while the latter is in service. However, such fabrication is troublesome and uneconomical on the production line.

It is one of the objects of the present invention to provide an improved outside door handle assembly with a highly convenient and well-functional rod-handle pivot connection to be assembled in a specifically selected push-in and turning mode, requiring no mechanical fabrication work on site.

This and further objects, features and advantages of the invention will become more apparent as the description progresses with reference to the accompanying drawings.

DETAILED DESCRIPTION OF THE INVENTION

Figure 1:
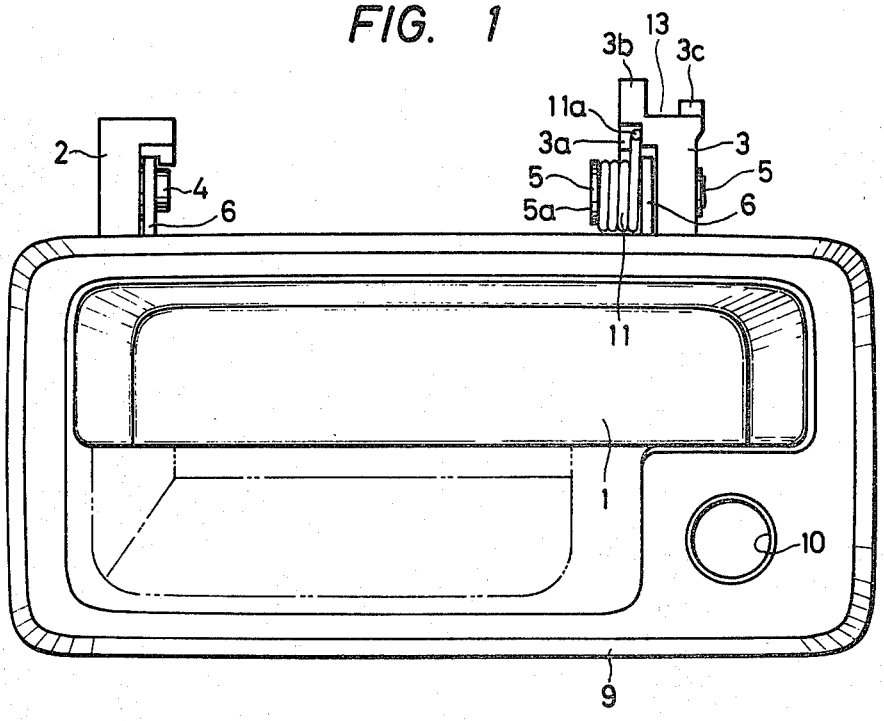
FIG. 1 is a front view of a preferred embodiment of the door handle assembly, without showing the door latch-operating rod to be pivotably attached thereto.

Now referring to the accompanying drawings, substantially a preferred embodiment will be described in detail.

Numeral 1 represents a somewhat elongated outside door handle proper or -arm having a thickened edge acting as a finger stop for easy manipulation of the door handle.

Symbols 2 and 3 are a pair of projecting arms of finger-like projections which are made integral with the handle arm proper 1 and have somewhat different configurations from each other.

The handle arm proper- and -projecting finger combination is pivotable at 4 and 5 relative to a bracket 6 rigidly connected at 7 and 8 with a housing piece 9 and a conventional automotive door panel, which is not shown for avoiding possible confusion of the drawn parts and because such door structures are well known to those skilled in the art.

The housing piece 9 is formed with a hole 10 adapted for receiving a conventional cylinder lock, not shown.

The finger projection 3 is provided at its free end with a pivot pin 5 made rigid therewith by a press fit, as an example, said pin carrying thereon the body part of a return coil spring 11 having first extension **11*a* abutting against a shoulder 3*a* formed on the finger projection 3. The spring 11 has another extension 11*b* which abuts on a projection 12 extending rigidly from the bracket 6 (refer specifically to FIG. 2). The pivot pin 5 is formed at its inner end with an enlarged head 5*a* for the prevention of unintentional slip-out of the coil spring. By the provision of this return coil spring 11, the handle arm 1** is resiliently urged towards its off-service position as shown.

The free end of finger projection 3 is formed into two finger elements **3*b* and 3*c* so as to provide an idle space 13 therebetween for allowing a partial turning movement of the Z-shaped end bend 14*a*; 14*b*; 14*c* of latch-operating rod 14** during assembly.

Inner finger element **3*b* is formed with a substantially half round recess 20 downwardly opening and adapted for receiving the said rod end 14*a*. Outer finger element 3*c* has an upwardly opening, substantially half round recess to provide a half bearing for the rod end portion 14*a*** as will be later more fully described.

Figure 2:
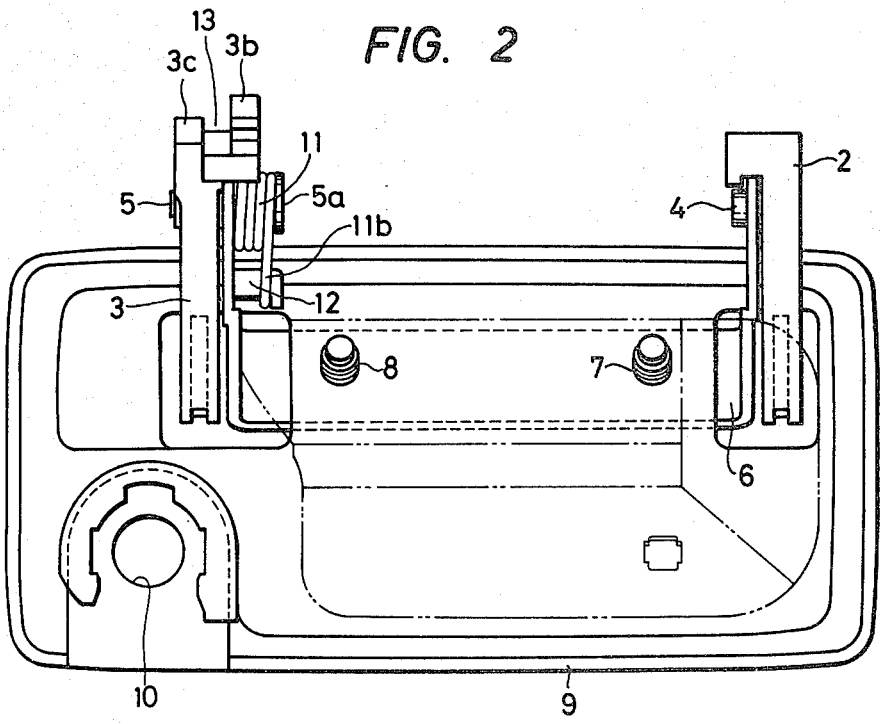
FIG. 2 is a rear side view of the door handle assembly shown in FIG. 1.
Figure 5:
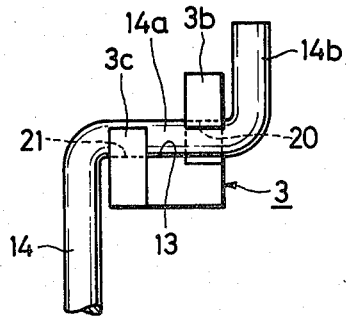
FIG. 5 is a top plan view of the rod-receiving end of a finger projection 3.
Figure 3:
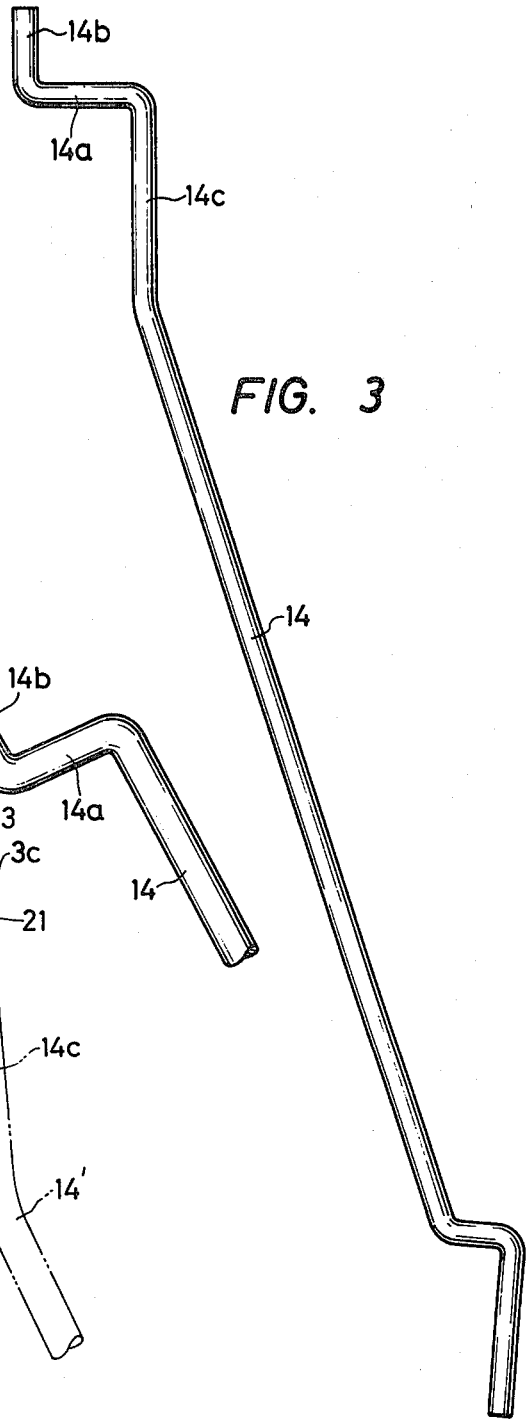
FIG. 3 is a side view of a handle arm-latch operating rod to be assembled together.
Figure 4:
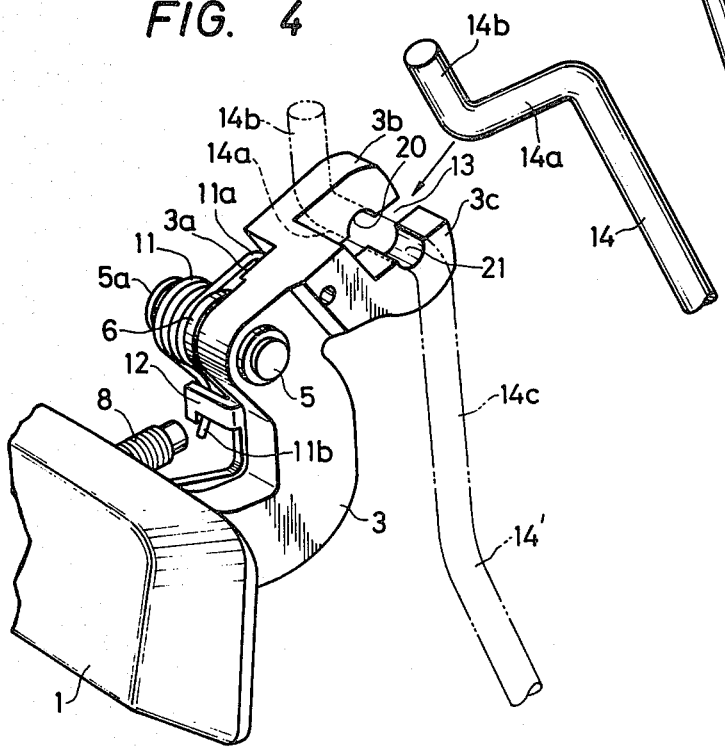
FIG. 4 is a detailed perspective view of one of the handle arm projections which is shown as ready for receiving the top end of the latch operating rod.

When assembling the outside door handle assembly, the sub-assembly shown in FIGS. 1 and 2 is assembled in a conventional manner. For attaching the door latch operating rod 14 thereto, the workman grips it by his hand substantially at the middle thereof, directing however, its Z-shaped end substantially upwards and somewhat inclined, and introduces the intermediate portion **14*a* of such rod end into the open sapce 13 between the both finger elements Then, the rod 14 is slightly turned clockwise in FIG. 4 until the middle part 14*a* of the Z is conjointly received in the axially staggered half-bearing recesses 20 and 21. This service position of the Z-end of the rod is shown at 14' in imaginary lines in FIG. 4**.

Thus, the rod 14 can be set in a push-in and turning mode without execution of any additional afterfabrication. Therefore, according to this, the assembly job of the outside door handle with the latch operating rod can be highly simplified and economized.

In addition, it is stressed that the no spring bearing pivot pin 4 is formed integrally with the first finger projection 2 by molding, while the spring bearing pivot pin 5 is made in a separate metal piece from the second finger projection 3.

Thus, the handle arm 1, both finger projections 2 and 3 and one side pivot pin 4 for the bracket 6 are made integral by resin injection molding in one fabrication step. Therefore, the assembly of the bracket 6 with the sub-assembly of door arm 1; 2 and 3 can be highly simplified, because conventionally, the both pivot pins at 4 and 5 must be attached in position by an additional mechanical step. In the present invention, however, such additional mechanical step can be dispensed with for the one pivot pin at 4.

The operational mode of the present outside door handle assembly is the same as a conventional handle. By raising manually the handle arm 1 upwards against the action of return coil spring 11, motion is transmitted therefrom through the rod 14 towards the latch operating mechanism, not shown, for release of the door latch, again not shown. By release the operator's hand from the outside door handle, the latter is brought to its off-service normal position shown in FIGS. 1 and 2.

The embodiments of the invention in which an exclusive property or privilege is claimed are as follows:

1. An outside door handle assemby comprising:

a door handle arm made of a plastic resin material and mounted on a door of an automotive vehicle, a channel-shaped metal bracket fixedly attached to said door handle arm, a pair of finger projections made integral with the said door handle arm, a return coil spring mounted on one of said finger projections for resiliently urging said handle arm towards its upper, non-service regular position, a pair of pivot pins mounted on said finger projections, one of the said pivot pins mounting the said return coil spring, while the other of the said pivot pins bears no such return coil spring, a pair of half round bearing recesses formed on two finger elements extending from said finger projection that mounts the return coil spring, for providing a pair of axially staggered bearing halves that face in opposite directions, a door latch operation rod having a Z-shaped rod end, the middle portion of said Z being pivotably mounted on the said spaced, opposed bearing halves, respectively.

2. The outside door handle assembly of claim 1, wherein said one of said pivot pins bearing no return coil spring is made integral with the corresponding finger projection and made of a plastic resin material which is the same as that of the said handle arm, and the other pivot pin is made of a metal and afterfabricated with an enlarged head by means of a pressing operation, said head serving for the prevention of occasional slip-out of the said return coil.

* * * * *